US010724253B1

(12) United States Patent
Fries et al.

(10) Patent No.: US 10,724,253 B1
(45) Date of Patent: Jul. 28, 2020

(54) DUAL SNAP-IN HINGE AND METHOD OF USING THE SAME

(71) Applicants: Bror Fries, Hishult (SE); Frank W. Campbell, Lake Elmo, MN (US)

(72) Inventors: Bror Fries, Hishult (SE); Frank W. Campbell, Lake Elmo, MN (US)

( * ) Notice: Subject to any disclaimer, the term of this patent is extended or adjusted under 35 U.S.C. 154(b) by 0 days.

(21) Appl. No.: 15/442,917

(22) Filed: Feb. 27, 2017

Related U.S. Application Data

(62) Division of application No. 14/321,187, filed on Jul. 1, 2014, now abandoned.

(60) Provisional application No. 61/842,085, filed on Jul. 2, 2013.

(51) Int. Cl.

| | |
|---|---|
| ***E04F 21/00*** | (2006.01) |
| ***E06B 3/32*** | (2006.01) |
| ***E05D 1/06*** | (2006.01) |
| ***E06B 7/36*** | (2006.01) |
| ***E06B 3/70*** | (2006.01) |

(52) U.S. Cl.
CPC ..... *E04F 21/0023* (2013.01); *E05D 1/06* (2013.01); *E06B 3/32* (2013.01); *E06B 7/36* (2013.01); *E06B 2003/7055* (2013.01)

(58) Field of Classification Search
CPC ..... E05D 5/0215; E05D 5/0238; E05D 7/10; E05D 7/12; Y10T 29/24
See application file for complete search history.

(56) References Cited

U.S. PATENT DOCUMENTS

| | | | | | |
|---|---|---|---|---|---|
| 616,952 | A * | 1/1899 | Morrison | E05D 7/12 | 16/271 |
| 2,207,836 | A * | 7/1940 | Sundell | E05D 7/12 | 16/254 |
| 2,605,925 | A * | 8/1952 | Morin | E05D 7/12 | 16/254 |
| 3,091,357 | A * | 5/1963 | Weinhart | A45C 13/005 | 16/260 |
| 3,285,464 | A * | 11/1966 | Boydman | E05D 1/02 | 220/377 |
| 3,423,786 | A * | 1/1969 | Henry, Jr. | E05D 7/12 | 16/257 |
| 3,590,419 | A * | 7/1971 | Dargene | E05D 7/12 | 16/235 |
| 3,728,758 | A * | 4/1973 | Johansen | E05D 7/02 | 16/257 |
| 3,782,592 | A * | 1/1974 | Bergh | E05D 7/12 | 220/829 |
| 3,921,225 | A * | 11/1975 | Suska | E05D 3/02 | 16/273 |
| 3,965,532 | A * | 6/1976 | Wigfall | E05D 7/12 | 16/270 |
| 4,175,315 | A * | 11/1979 | Hayes, Sr. | B29C 45/00 | 16/380 |
| 4,713,861 | A * | 12/1987 | Bancroft | E05D 5/125 | 16/222 |
| 5,193,308 | A * | 3/1993 | Davidian | E05D 5/023 | 16/257 |
| 5,239,729 | A * | 8/1993 | Scholl | B65F 1/1646 | 16/231 |

(Continued)

*Primary Examiner* — Christopher M Koehler
(74) *Attorney, Agent, or Firm* — Dicke, Billig & Czaja, PLLC

(57) ABSTRACT

A dual hinge method that uses a temporary hinge 150 that is subsequently replaced by a replacement hinge 250 that both have snap-in features on both the panel leaf and frame jamb.

25 Claims, 20 Drawing Sheets

(56) References Cited

U.S. PATENT DOCUMENTS 5,339,493 A * 8/1994 MacIntyre ..... E05D 7/0423 16/237
5,381,920 A * 1/1995 Lin ..... B25H 3/02 16/261
5,562,315 A * 10/1996 Sales ..... E05C 1/04 292/150
5,832,670 A * 11/1998 Bennett ..... E05D 7/02 49/382
6,016,629 A * 1/2000 Sylvester ..... E05B 65/0007 49/394
6,030,064 A * 2/2000 Kim ..... E05D 7/0423 16/271
6,715,181 B1 * 4/2004 Fries ..... E05D 7/0415 16/271
7,350,272 B2 4/2008 Fries
7,516,517 B2 4/2009 Fries
7,552,511 B2 6/2009 Campbell et al.
7,661,226 B2 * 2/2010 Kibbel ..... E05B 63/14 49/382
7,694,388 B2 4/2010 Campbell et al.
8,317,163 B1 * 11/2012 Cammack ..... F16B 7/0433 16/86.1
8,863,358 B2 * 10/2014 Ochs ..... E05D 7/0009 16/238
2001/0011406 A1 * 8/2001 Nakamoto ..... E05D 7/0027 16/271
2003/0122047 A1 * 7/2003 Joliey ..... G09F 3/204 248/300
2004/0034966 A1 * 2/2004 Wegman ..... E05D 5/06 16/254
2004/0200035 A1 * 10/2004 Fries ..... E05D 7/02 16/238
2005/0193521 A1 * 9/2005 Heid ..... E05D 7/0027 16/271
2007/0039973 A1 * 2/2007 Boenig ..... A45C 13/005 220/847
2008/0022491 A1 * 1/2008 Campbell ..... E05D 7/0423 16/236
2008/0307606 A1 * 12/2008 Karlsson ..... E05D 7/0415 16/243
2012/0066864 A1 * 3/2012 Boegel-Poetter ..... E05D 11/0081 16/273
2012/0073083 A1 * 3/2012 Staude ..... E05D 11/0081 16/385

* cited by examiner

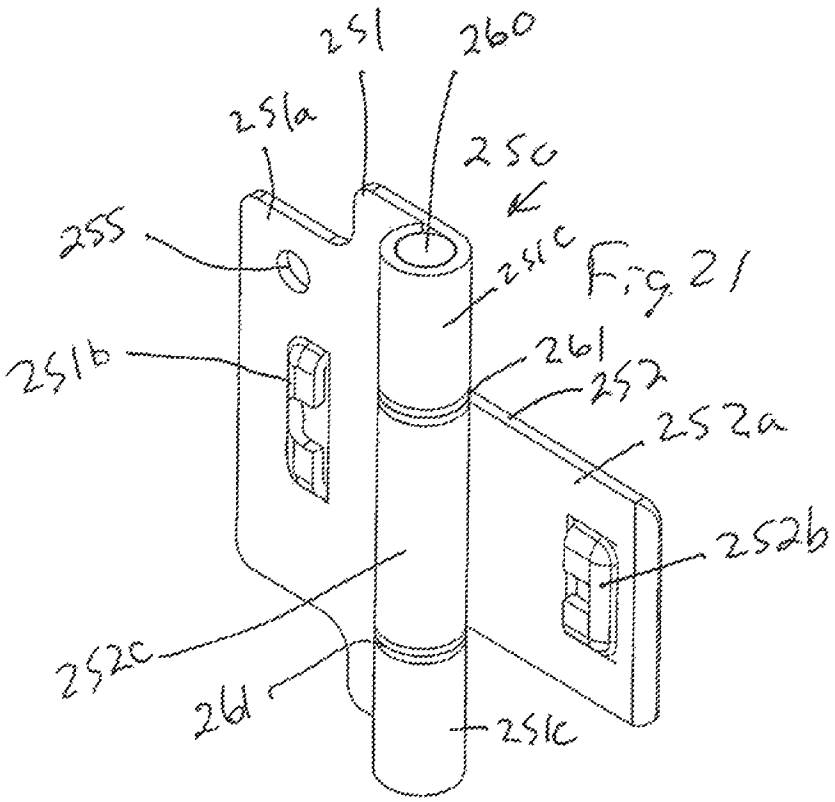
Fig. 21
250
252
252a
252b
252c
252d
252e
252f
252g
252h
252i
252j
252k
252l
252m
252n
252o
252p
252q
252r
252s
252t
252u
252v
252w
252x
252y
252z
252aa
252ab
252ac
252ad
252ae
252af
252ag
252ah
252ai
252aj
252ak
252al
252am
252an
252ao
252ap
252aq
252ar
252as
252at
252au
252av
252aw
252ax
252ay
252az
252ba
252bb
252bc
252bd
252be
252bf
252bg
252bh
252bi
252bj
252bk
252bl
252bm
252bn
252bo
252bp
252bq
252br
252bs
252bt
252bu
252bv
252bw
252bx
252by
252bz
252ca
252cb
252cc
252cd
252ce
252cf
252cg
252ch
252ci
252cj
252ck
252cl
252cm
252cn
252co
252cp
252cq
252cr
252cs
252ct
252cu
252cv
252cw
252cx
252cy
252cz
252da
252db
252dc
252dd
252de
252df
252dg
252dh
252di
252dj
252dk
252dl
252dm
252dn
252do
252dp
252dq
252dr
252ds
252dt
252du
252dv
252dw
252dx
252dy
252dz
252ea
252eb
252ec
252ed
252ee
252ef
252eg
252eh
252ei
252ej
252ek
252el
252em
252en
252eo
252ep
252eq
252er
252es
252et
252eu
252ev
252ew
252ex
252ey
252ez
252fa
252fb
252fc
252fd
252fe
252ff
252fg
252fh
252fi
252fj
252fk
252fl
252fm
252fn
252fo
252fp
252fq
252fr
252fs
252ft
252fu
252fv
252fw
252fx
252fy
252fz
252ga
252gb
252gc
252gd
252ge
252gf
252gg
252gh
252gi
252gj
252gk
252gl
252gm
252gn
252go
252gp
252gq
252gr
252gs
252gt
252gu
252gv
252gw
252gx
252gy
252gz
252ha
252hb
252hc
252hd
252he
252hf
252hg
252hh
252hi
252hj
252hk
252hl
252hm
252hn
252ho
252hp
252hq
252hr
252hs
252ht
252hu
252hv
252hw
252hx
252hy
252hz
252ia
252ib
252ic
252id
252ie
252if
252ig
252ih
252ii
252ij
252ik
252il
252im
252in
252io
252ip
252iq
252ir
252is
252it
252iu
252iv
252iw
252ix
252iy
252iz
252ja
252jb
252jc
252jd
252je
252jf
252jg
252jh
252ji
252jj
252jk
252jl
252jm
252jn
252jo
252jp
252jq
252jr
252js
252jt
252ju
252jv
252jw
252jx
252jy
252jz
252ka
252kb
252kc
252kd
252ke
252kf
252kg
252kh
252ki
252kj
252kk
252kl
252km
252kn
252ko
252kp
252kq
252kr
252ks
252kt
252ku
252kv
252kw
252kx
252ky
252kz
252la
252lb
252lc
252ld
252le
252lf
252lg
252lh
252li
252lj
252lk
252ll
252lm
252ln
252lo
252lp
252lq
252lr
252ls
252lt
252lu
252lv
252lw
252lx
252ly
252lz
252ma
252mb
252mc
252md
252me
252mf
252mg
252mh
252mi
252mj
252mk
252ml
252mm
252mn
252mo
252mp
252mq
252mr
252ms
252mt
252mu
252mv
252mw
252mx
252my
252mz
252na
252nb
252nc
252nd
252ne
252nf
252ng
252nh
252ni
252nj
252nk
252nl
252nm
252nn
252no
252np
252nq
252nr
252ns
252nt
252nu
252nv
252nw
252nx
252ny
252nz
252oa
252ob
252oc
252od
252oe
252of
252og
252oh
252oi
252oj
252ok
252ol
252om
252on
252oo
252op
252oq
252or
252os
252ot
252ou
252ov
252ow
252ox
252oy
252oz
252pa
252pb
252pc
252pd
252pe
252pf
252pg
252ph
252pi
252pj
252pk
252pl
252pm
252pn
252po
252pp
252pq
252pr
252ps
252pt
252pu
252pv
252pw
252px
252py
252pz
252qa
252qb
252qc
252qd
252qe
252qf
252qg
252qh
252qi
252qj
252qk
252ql
252qm
252qn
252qo
252qp
252qq
252qr
252qs
252qt
252qu
252qv
252qw
252qx
252qy
252qz
252ra
252rb
252rc
252rd
252re
252rf
252rg
252rh
252ri
252rj
252rk
252rl
252rm
252rn
252ro
252rp
252rq
252rr
252rs
252rt
252ru
252rv
252rw
252rx
252ry
252rz
252sa
252sb
252sc
252sd
252se
252sf
252sg
252sh
252si
252sj
252sk
252sl
252sm
252sn
252so
252sp
252sq
252sr
252ss
252st
252su
252sv
252sw
252sx
252sy
252sz
252ta
252tb
252tc
252td
252te
252tf
252tg
252th
252ti
252tj
252tk
252tl
252tm
252tn
252to
252tp
252tq
252tr
252ts
252tt
252tu
252tv
252tw
252tx
252ty
252tz
252ua
252ub
252uc
252ud
252ue
252uf
252ug
252uh
252ui
252uj
252uk
252ul
252um
252un
252uo
252up
252uq
252ur
252us
252ut
252uu
252uv
252uw
252ux
252uy
252uz
252va
252vb
252vc
252vd
252ve
252vf
252vg
252vh
252vi
252vj
252vk
252vl
252vm
252vn
252vo
252vp
252vq
252vr
252vs
252vt
252vu
252vv
252vw
252vx
252vy
252vz
252wa
252wb
252wc
252wd
252we
252wf
252wg
252wh
252wi
252wj
252wk
252wl
252wm
252wn
252wo
252wp
252wq
252wr
252ws
252wt
252wu
252wv
252ww
252wx
252wy
252wz
252xa
252xb
252xc
252xd
252xe
252xf
252xg
252xh
252xi
252xj
252xk
252xl
252xm
252xn
252xo
252xp
252xq
252xr
252xs
252xt
252xu
252xv
252xw
252xx
252xy
252xz
252ya
252yb
252yc
252yd
252ye
252yf
252yg
252yh
252yi
252yj
252yk
252yl
252ym
252yn
252yo
252yp
252yq
252yr
252ys
252yt
252yu
252yv
252yw
252yx
252yy
252yz
252za
252zb
252zc
252zd
252ze
252zf
252zg
252zh
252zi
252zj
252zk
252zl
252zm
252zn
252zo
252zp
252zq
252zr
252zs
252zt
252zu
252zv
252zw
252zx
252zy
252zz

DUAL SNAP-IN HINGE AND METHOD OF USING THE SAME

CROSS-REFERENCE TO RELATED APPLICATION

This application claims the benefit of U.S. patent application Ser. No. 14/321,187, filed Jul. 1, 2014; which claims priority to U.S. Provisional Patent Application Ser. No. 61/842,085, DUAL SNAP-IN HINGE AND METHOD OF USING THE SAME, filed on Jul. 2, 2013, which are incorporated in their entirety herein by reference.

BACKGROUND OF THE INVENTION

1. Field of the Invention

This invention relates generally to a dual snap-in hinge and a method of using the same.

2. Description of the Prior Art

While snap-in hinges have been used in the past, one leaf of the snap-in hinge has been secured to either a panel or a frame jamb. Accordingly, the barrel of the hinge has always been shipped from the factory attached to either the frame jamb or door. This results in at least two issues. The first is the increased cost and damage caused by having the barrel protrude from the edge of the door panel or jamb. The second is since the barrel is always secured to one of the two members (frame jamb or panel), the color style of the barrel is not easily exchangeable. There is a strong desire to have the finish of the barrel and leaves match other finishes that are used throughout a house. This is not easily done with the prior art as it is well known that once screws from the leaf of a hinge are removed from a door jamb and/or panel, a substantial amount of the structural strength is lost when screws are reinserted into the leaf and then the door jamb and/or panel.

The present invention addresses these two issues and also provides for a simpler and more economical horizontal adjustment mechanism.

SUMMARY OF THE INVENTION

In one embodiment, the invention is a method of manufacturing a door adapted and configured to having a dual snap-in hinge. The method includes forming at least two jamb recesses in a frame jamb. Also, two panel recesses are formed in a panel. A frame jamb receiver is fastened in each of the frame jamb recesses, the frame jamb receiver having a cut out section and a first portion of a snap-in connection. A panel receiver is fastened in each of the panel recesses. The panel receiver has a cut out section and a first portion of a snap-in connection. The frame jamb is secured to the panel with a temporary hinge, the temporary hinge having a frame jamb leaf with a second portion of a snap-in connection. The frame jamb leaf is positioned in the frame jamb receiver cut out section and secured in the frame jamb receiver by the frame second portion of a snap-in connection snapping in the frame first portion of a snap-in connection. The temporary hinge further has a panel leaf with a second portion of a snap-in connection. The panel leaf is positioned in the panel receiver cut out section and secured in the panel receiver by the panel second portion of a snap-in connection snapping in the panel first portion of a snap-in connection. The frame jamb leaf is operatively connected to the panel leaf by a flexible portion, whereby the frame jamb and panel can be moved between an open position to a closed position.

In another embodiment, the invention is a method of manufacturing a door adapted and configured to have a dual snap-in hinge. The method includes forming at least two frame jamb recesses in a frame jamb. At least two panel recesses are formed in a panel. A frame jamb receiver is fastened in each of the frame jamb recesses, the frame jamb receiver having a cut out section and a first portion of a snap-in connection. A panel receiver is fastened in each of the panel recesses, the panel receiver has a cut out section and a first portion of a snap-in connection. The frame jamb is secured to the panel with a hinge. The hinge has a frame jamb leaf with a second portion of a snap-in connection. The frame jamb leaf is positioned in the frame jamb receiver cut out section and secured in the frame jamb receiver by the frame second portion of a snap-in connection snapping in the frame first portion of a snap-in connection. The hinge further has a panel leaf with a second portion of a snap-in connection. The panel leaf is positioned in the panel recess cut out section and secured in the panel receiver by the panel second portion of a snap-in connection snapping in the panel first portion of a snap-in connection. The frame jamb leaf is operatively connected to the panel leaf by a flexible portion, whereby the frame jamb and panel can be moved between an open position to a closed position.

In another embodiment, the invention is a method of installing a door assembly having a panel and a jamb. The method includes installing the door assembly, having a temporary hinge, to a wall. The temporary hinge is removed by releasing a snap fit between a jamb leaf and a jamb receiver and also releasing the snap fit between a panel leaf and a panel receiver. The temporary hinge is replaced with a replacement hinge by snapping a replacement hinge panel leaf into the panel receiver and snapping a replacement hinge jamb leaf into the jamb receiver.

In another embodiment, the invention is a dual snap-in hinge and receiver combination. The combination includes a hinge having a jamb leaf rotatably connected to a panel leaf. A jamb receiver is adapted and configured to be secured to a jamb. A panel receiver is adapted and configured to be secured to a panel. The jamb receiver has a first portion of a snap-in connection and a panel receiver has a first portion of a snap-in connection. The jamb leaf has a second portion of a snap-in connection for a snap-in connection to the jamb receiver. The panel leaf has a second portion of snap-in connection for a snap-in connection to the panel receiver, wherein the hinge may be removed both the panel receiver and the leaf receiver without removing any screws.

BRIEF DESCRIPTION OF THE DRAWINGS

FIG. 21 is a perspective view of a finished hinge;

FIG. 28 is a perspective view of a factory door assembly with a temporary hinge.

DETAILED DESCRIPTION OF A PREFERRED EMBODIMENT

Figure 22:
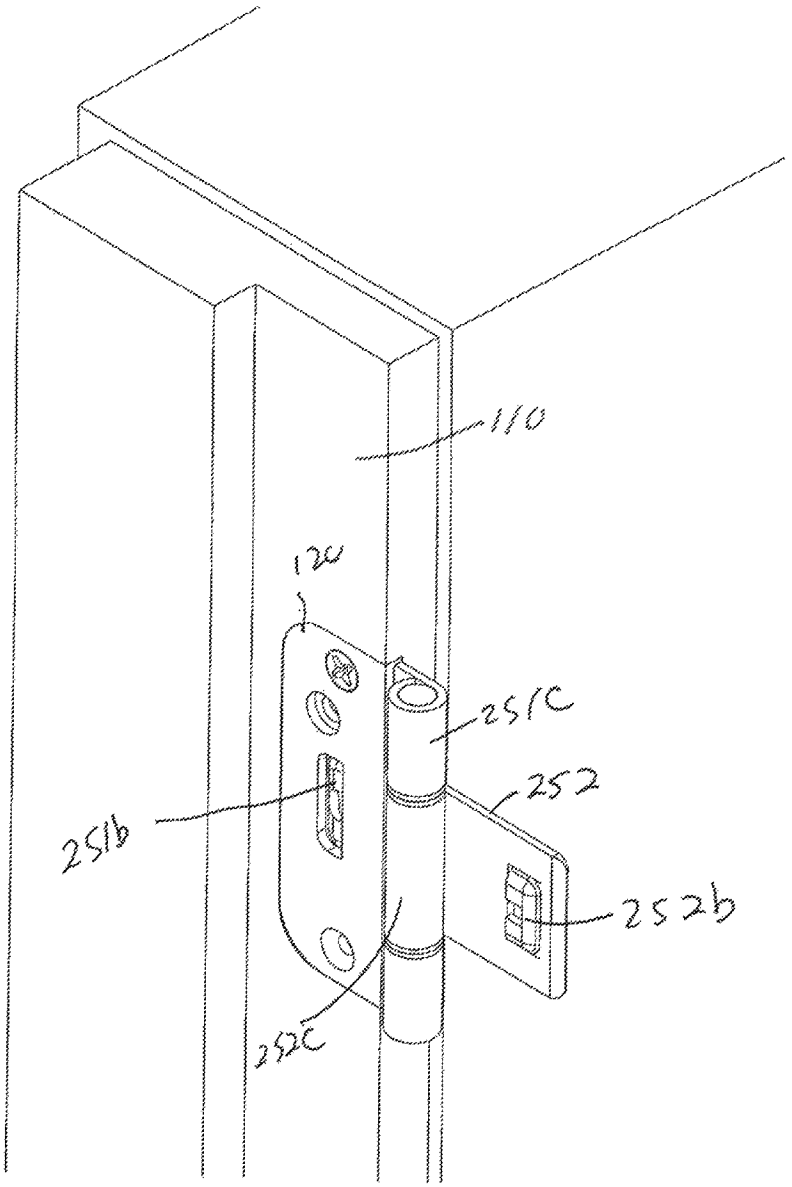
FIG. 22 is a perspective view of the finished hinge inserted into the frame receiver, with the panel removed.
Figure 23:
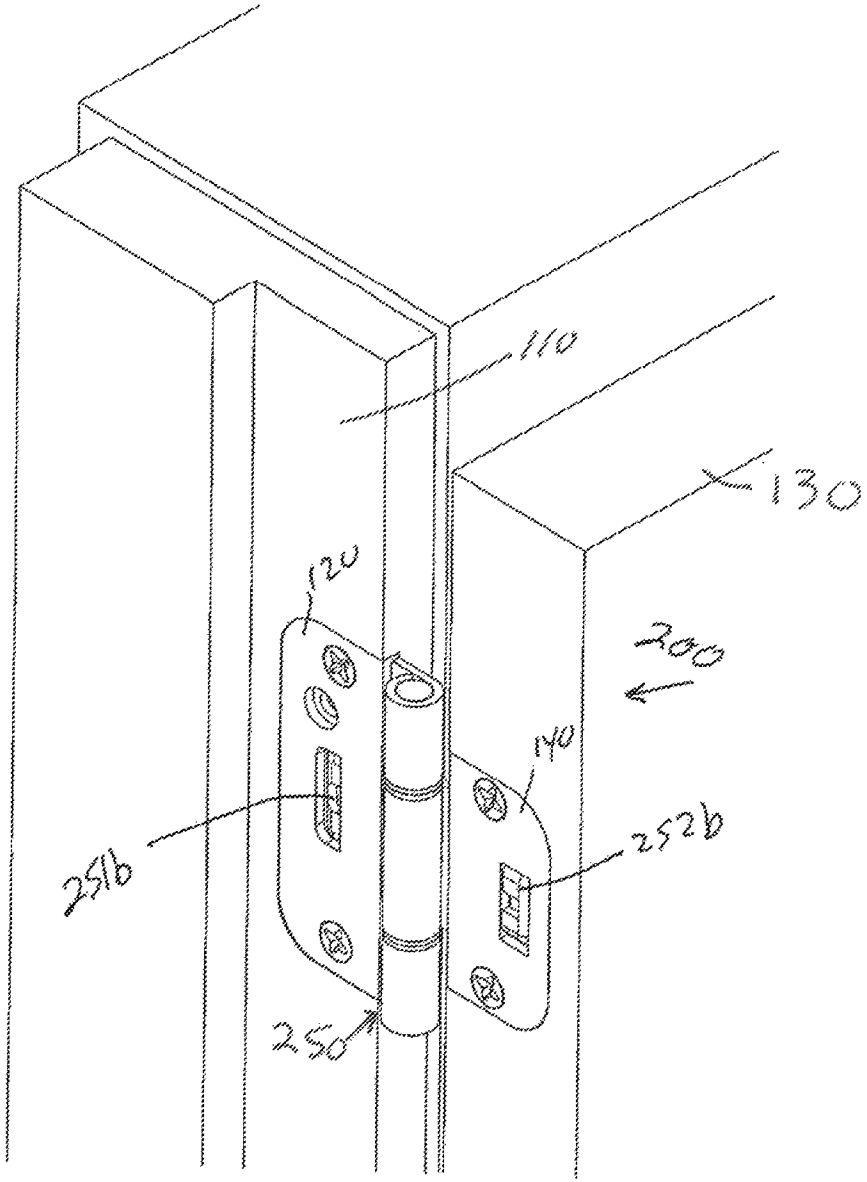
FIG. 23 is a perspective view of the finished hinge assembled to both the panel and frame jam.
Figure 29:
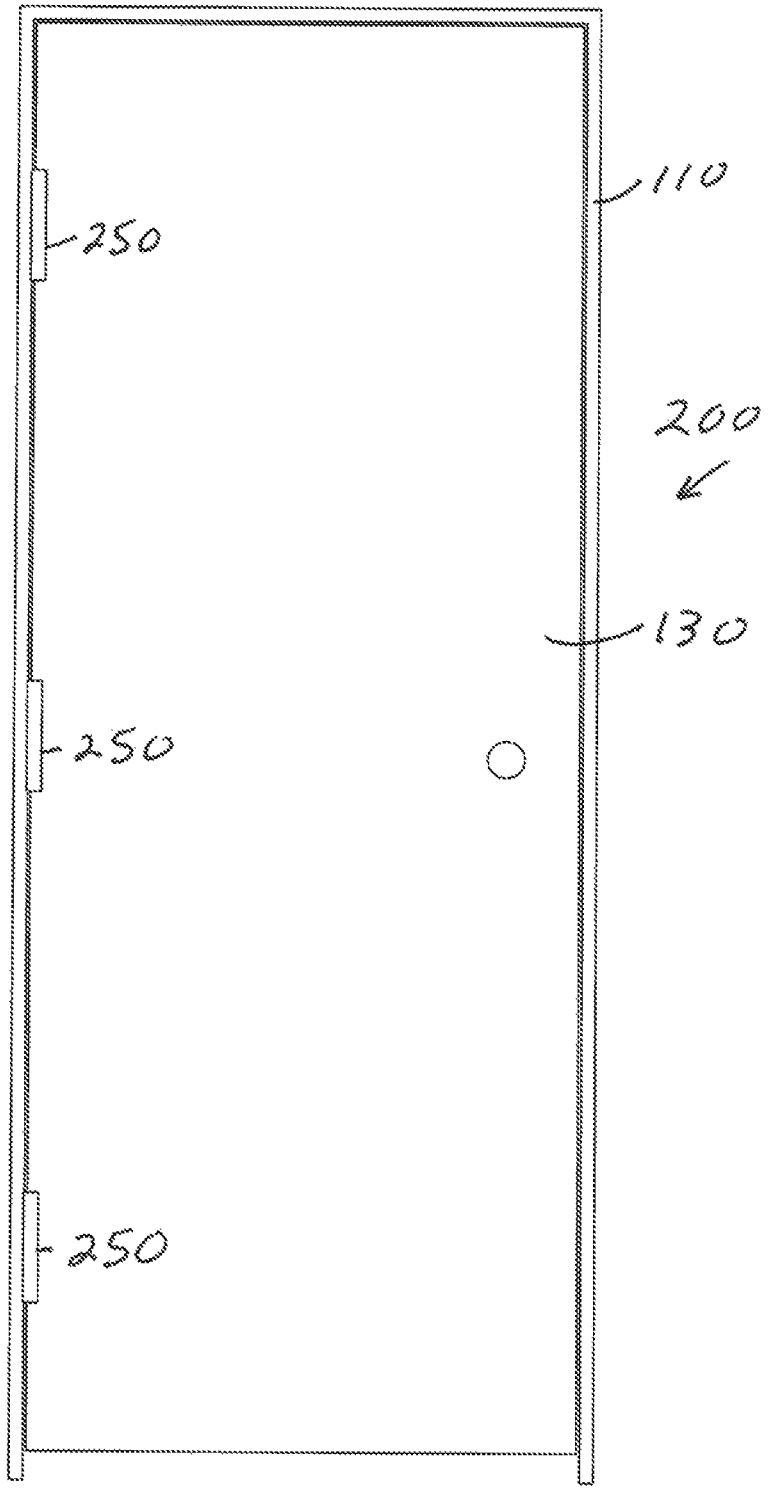
FIG. 29 is a perspective view of a door assembly with a permanent replacement hinge.

Referring to the drawings, wherein like numerals represent like parts throughout the several views, there is generally shown at 100 (FIGS. 16 and 28) a factory door assembly. The factory door assembly 100 includes a frame jamb 110 having a frame receiver 120; a panel 130; a panel receiver 140; and a temporary hinge 150. Generally disclosed at 200 (FIGS. 22 and 29) is a door assembly, which includes the same frame jamb 110, frame receiver 120, panel 130 and panel receiver 140. However, a replacement hinge 250 is utilized instead of a temporary hinge 150.

As will be described more fully hereafter, the factory door assembly 100 is secured to a wall 300 and a replacement hinge 250 then replaces the temporary hinge 150. Although, it is understood, that the replacement hinge 250 may replace the temporary hinge 150 prior to being secured to the wall 300. Alternately, the replacement hinge 150 may be installed at the factory and no temporary hinge is used.

Figure 1:
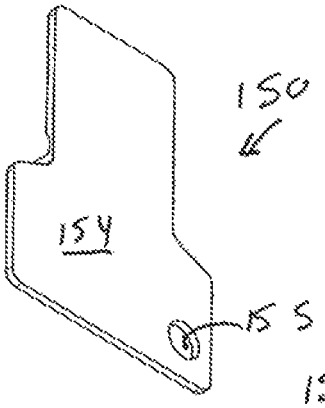
FIG. 1 is a perspective view of a temporary hinge showing the underneath side of the temporary hinge.
Figure 2:
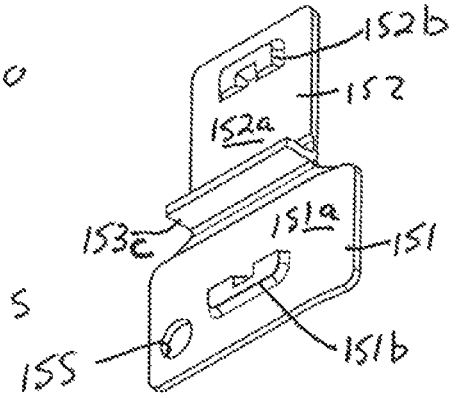
FIG. 2 is a perspective view of the temporary hinge, shown in FIG. 1, generally viewed from above.
Figure 3:
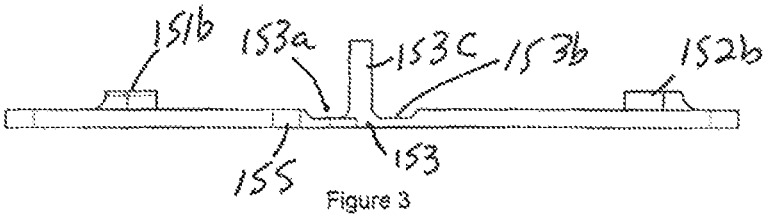
FIG. 3 is a side elevational view of the temporary hinge shown in FIG. 1.
Figure 18:
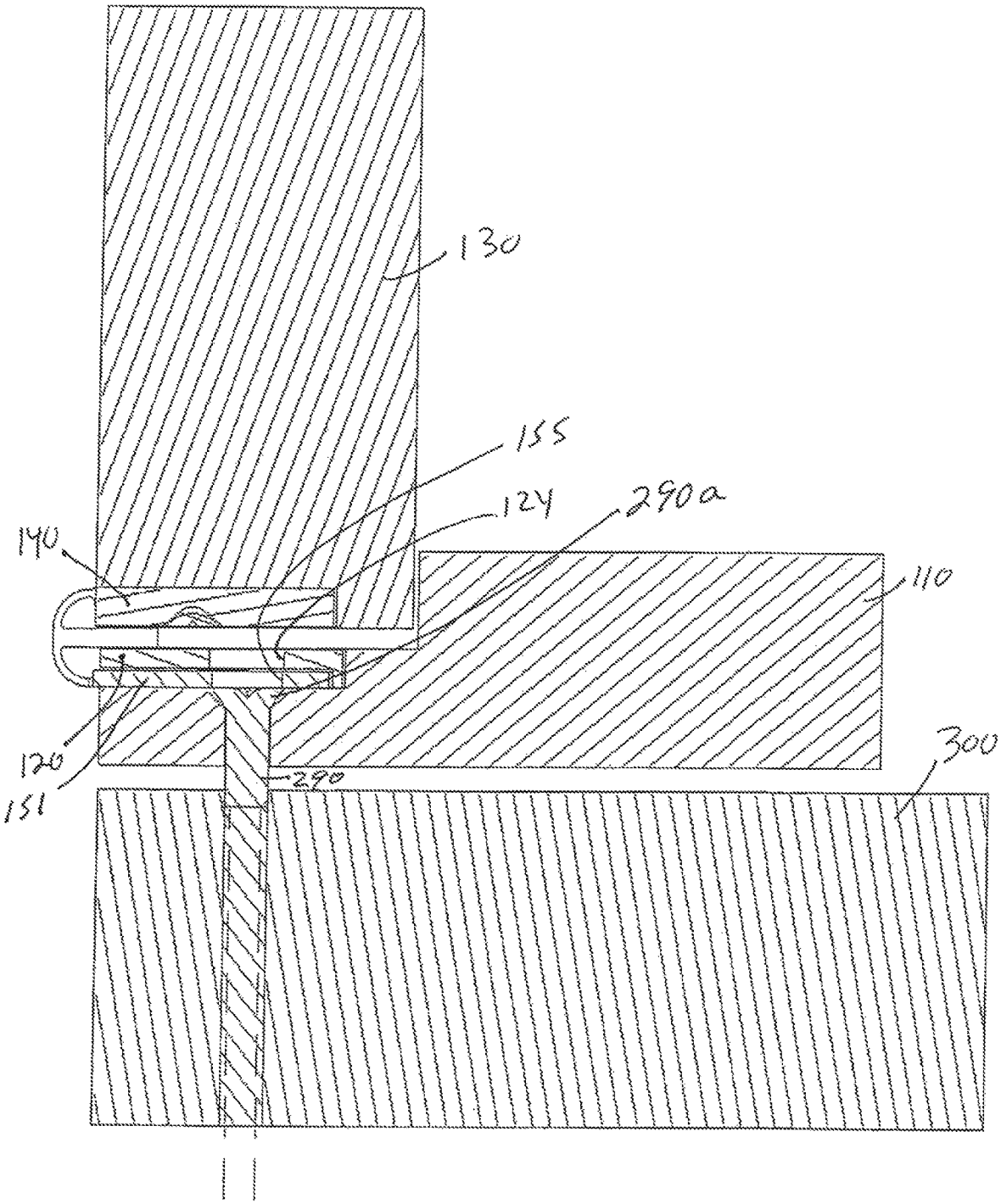
FIG. 18 is a cross-sectional view of the factory assembled temporary hinge with the door jamb assembled to a wall taken through the installation screw.

The temporary hinge 150 is constructed from a durable material such as plastic, i.e., polypropylene. The temporary hinge 150 as two relatively flat portions, frame jamb leaf 151 and panel leaf 152, operatively connected to a flexible portion 153. The temporary hinge 150 has a generally planar bottom surface 154. The temporary hinge 150, so far described, generally resembles a "living hinge" which is well known in the art. However, the "living hinge" does not have the snap-in capabilities, spacer capabilities or provisions for use of an installation/adjustment screw as does the present temporary hinge, as will be more fully described hereafter. The top surface 151*a* of the frame jamb leaf 151 is generally planar also, except for protrusion 151*b* that extends upward. A protrusion 151*b* is sized and configured to be received, with a snap-in motion, by the jamb receiver 120, as will be discussed more fully hereafter. Similarly, the panel leaf 152 has a generally planar top surface 152*a* and also a protrusion 152*b* sized and configured to be received by the panel receiver 140, as will be discussed more fully hereafter. A flexible portion 153 has two grooves 153*a* and 153*b* formed therein to make that section of the flexible portion 153 approximately one-half as thick as the remainder of the temporary hinge 150. These grooves 153*a* and 153*b* of the leaves 151, 152 must be thin enough to allow the temporary hinge 150 to bend upward to a position as shown in FIG. 18. An elongate section 153*c* extends upward, as shown in FIGS. 2 and 3. The elongate section 153*c* acts as a spacer between the panel 130 and frame jamb 110. In addition, the frame jamb leaf 151 has an aperture 155 formed therein. The aperture 155 is utilized for the insertion of an installation screw 290 as will be described more fully hereafter. The aperture 155 could also be a slot so that the opening would extend to the edge of the frame jamb leaf 151.

Figure 5:
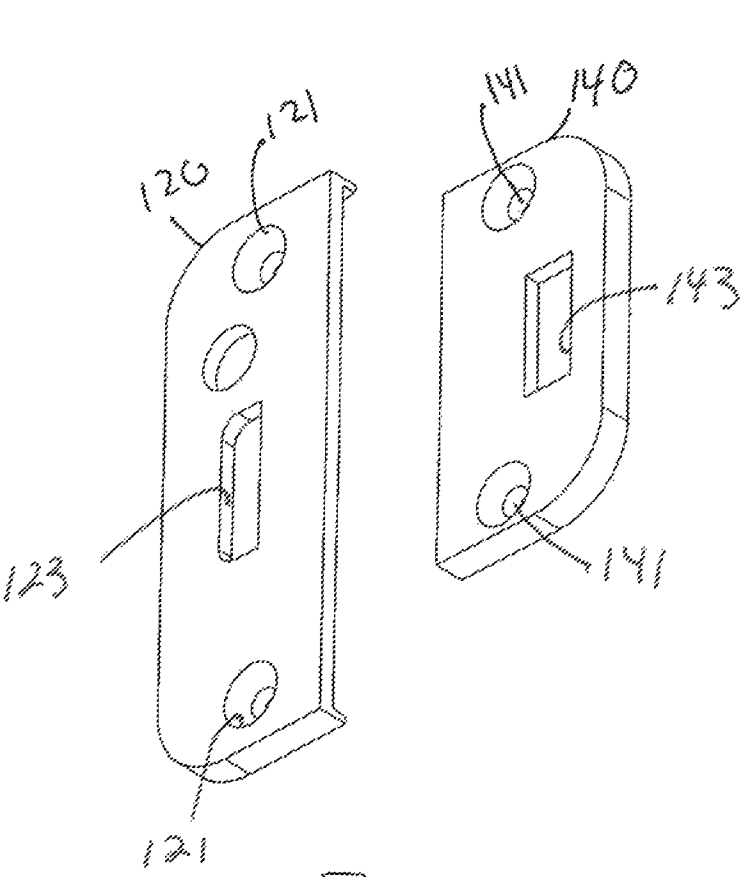
FIG. 5 is a perspective view of the receivers shown in FIG. 4, shown generally from the top.
Figure 4:
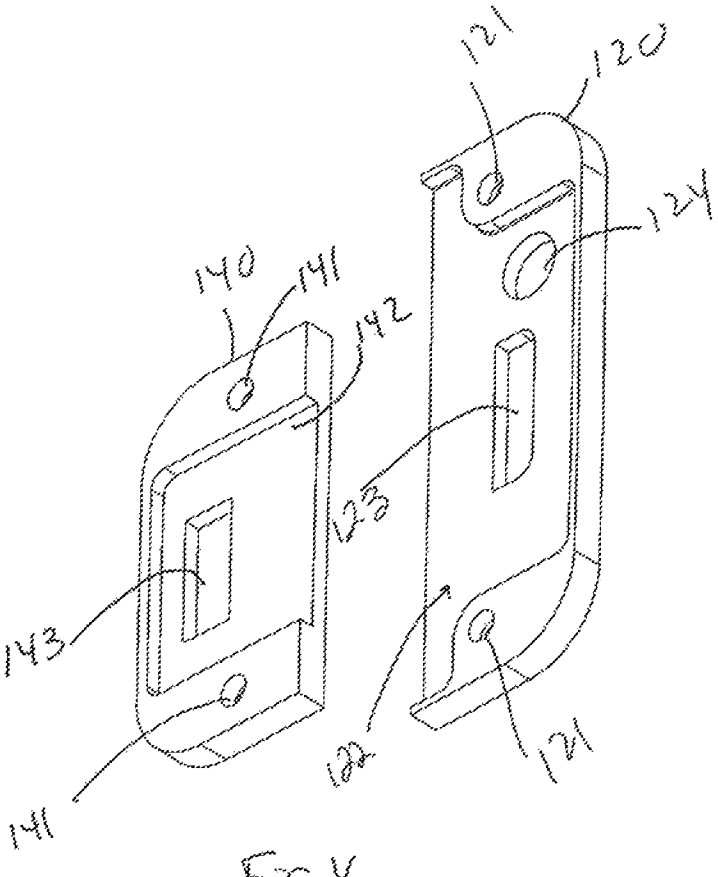
FIG. 4 is a bottom perspective view of the panel receiver and frame receiver.
Figure 15:
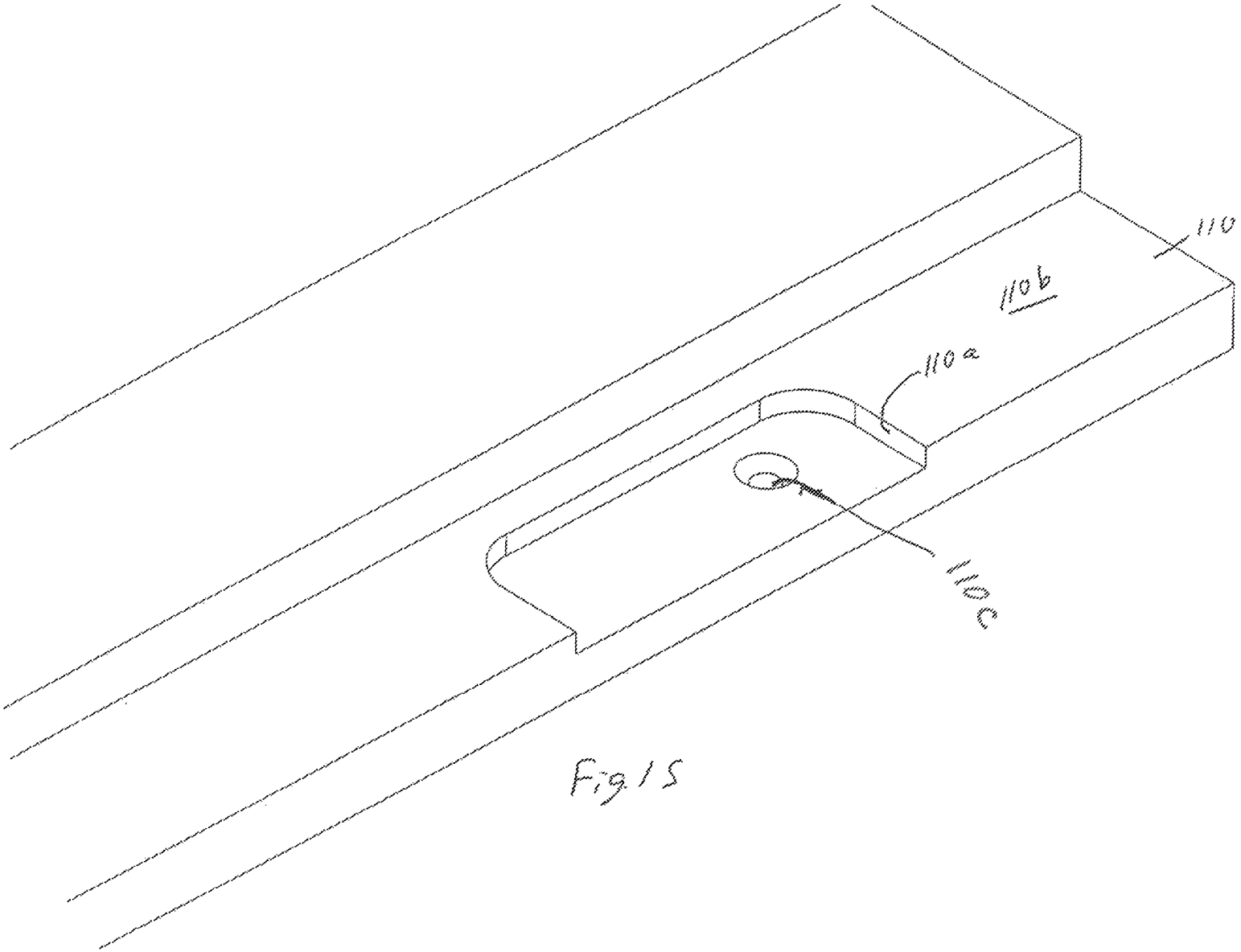
FIG. 15 is a perspective view of a portion of the frame jamb, showing a recess for receiving the jamb receiver and installation screw.

The frame receiver 120 and panel receiver 140 are each formed from a suitable material such as plastic, i.e., a polyamide such as Nylon™ or acetal, or they may be formed from a suitable metal. The frame receiver 120 is sized and configured to fit into a recess 110*a* as shown in FIG. 15. The recess 110*a* is sized so that the frame receiver 120 is flush mounted to a top surface 110*b*. A plurality of recesses 110*a* may be formed along the length of the frame jamb 110, depending upon the number of frame receivers that would be used for the door assembly 200. Typically, this would be two to four receivers, depending on the height and weight of the panel 130. Similarly, the panel receiver 140 is sized and configured to fit in recess 130*a* formed in the panel 130. The panel receiver 140 is also flush mounted to be flush mounted with the side planar surface 130*b* of the panel 130. The frame receiver 120 is generally rectangular in shape and has two mounting holes 121 extending through the frame receiver 120. A cutout section 122 is sized and configured to receive frame jamb leaf 151 of both the temporary hinge 150 and the frame jamb leaf 251 of the replacement hinge 250. The frame receiver 120 has a further snap opening 123 that is sized and configured to receive protrusion 151*b* or protrusion 251*b* of the replacement hinge 250. In addition, an aperture 124 is formed to align with aperture 155 as seen in FIG. 5. The aperture 124 and mounting holes 121 are countersunk.

Figure 16:
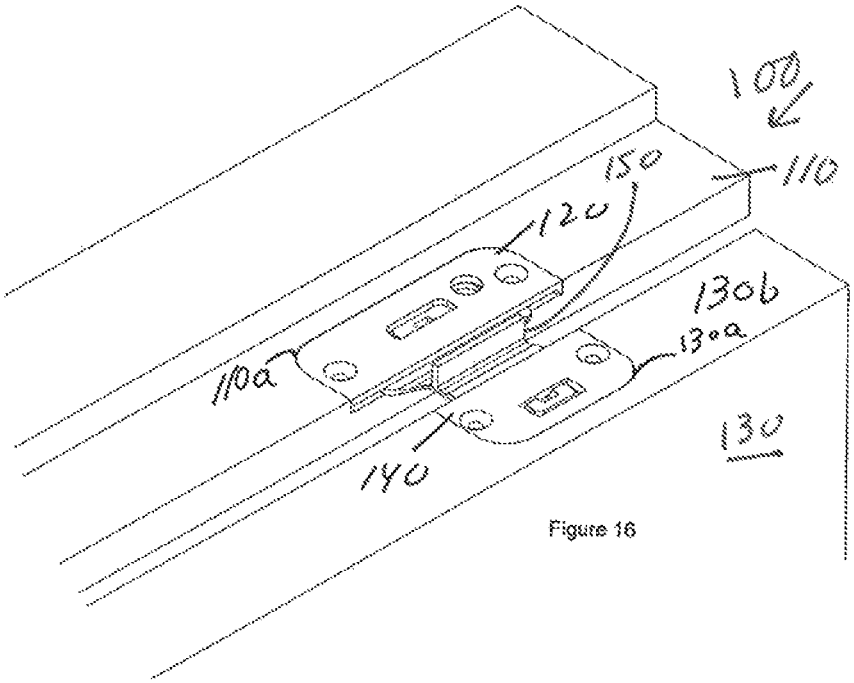
FIG. 16 is an enlarged perspective of the assembled temporary hinge to a frame jamb and panel.

The panel receiver 140 is sized and configured to fit into a recess 130*a* as shown in FIG. 16. The recess 130*a* is sized so that the panel receiver 140 is flush mounted to the side planar surface 130*b* of the panel 130. A plurality of recesses 110*a* may be formed along the length of the panel 130, depending upon the number of frame receivers that would be used for the door assembly 200. The panel receiver 140 is generally rectangular in shape and has two mounting holes 141 extending through the panel receiver 140. A cutout section 142 is sized and configured to receive panel jamb leaf 152 of both the temporary hinge 150 and the panel jamb leaf 252 of the replacement hinge 250. The panel receiver 140 has a further snap opening 143 that is sized and configured to receive protrusion 152*b* or protrusion 252*b* of the replacement hinge 250. The mounting holes 121 are countersunk.

Referring now to FIGS. 21 through 27, there is generally shown the replacement hinge 250 and the permanent door assembly 200. The replacement hinge 250 includes a frame jamb leaf 251, panel leaf 252, pin 260 and bushings 261. The replacement hinge 250 can be referred to as a dual snap-in hinge. As used in this application a dual snap-in hinge is a hinge that has a snap-in fit for both the frame jamb leaf and the panel leaf. The frame jamb leaf 251 has an extension portion 251*a* that is sized and configured to be received into the cutout section 122 of the frame receiver 120. Integral with the frame jamb leaf 251 are two circular barrel extensions 251*c* that have bores that are in alignment. The panel leaf 252 has an extension portion 252*a* that is sized and configured to be received into the cutout section 142 of the panel receiver 140. A barrel extension 252*c* is preferably also integral and operatively connected to the extension portion 252*a*. The barrel extension 252*c* has a bore formed therein. The bores of the frame jamb leaf 251 and panel leaf 252 are in general alignment. Bushings 261 are placed between the barrel sections and a pin 260 is secured in position to the bores to form the replacement hinge 250. The replacement hinge 250, so far described, is of similar construction to a permanent hinge in the prior art. The replacement hinge 250 has a protrusion 251*b* extending outward from the extension portion 251*a*. Similarly, the panel leaf 252 has a protrusion 252*b* extending outward from the panel leaf 252. The protrusions 251*b*, 252*b* are sized and configured to be similar to protrusions 151*b*, 252*b*. The protrusions 251*b*, 252*b* are sized and configured to have a snap fit with the snap openings 123 and 143, as will be more fully described hereafter. In addition, the frame jamb leaf 251 has an aperture 255 formed therein and is in general alignment with the aperture 124 or a slot. One additional feature of this invention is that the pin 260 and bushings 261 are all constructed from a plastic material such as acetal, thereby eliminating any metal on metal squeaking. While the snap-in connections defined so far have protrusions, as the first portion of the snap-in connection, on the frame jamb leaf 151/251 and panel leaf 152/252 and a second portion of the snap-in connection, openings 123/143. It is understood that, while this is the preferred arrangement, the openings could appear on the leafs and the protrusions on the receivers.

Figure 9:
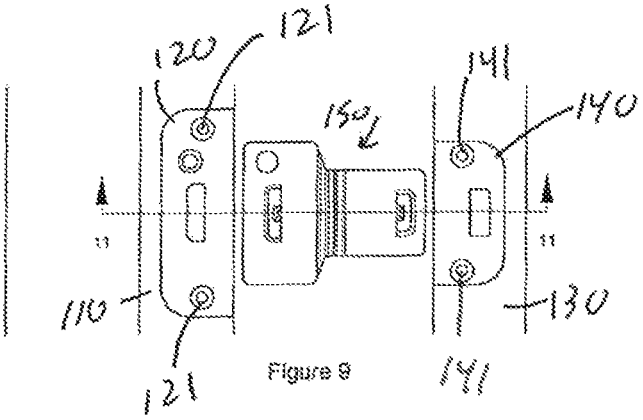
FIG. 9 is a side elevational view of the temporary hinge, shown just before assembly.
Figure 10:
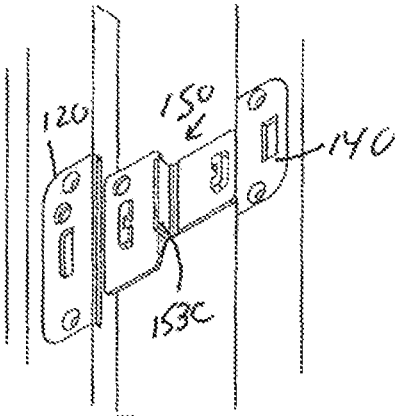
FIG. 10 is a perspective view of the temporary hinge, shown in FIG. 9.
Figure 11:
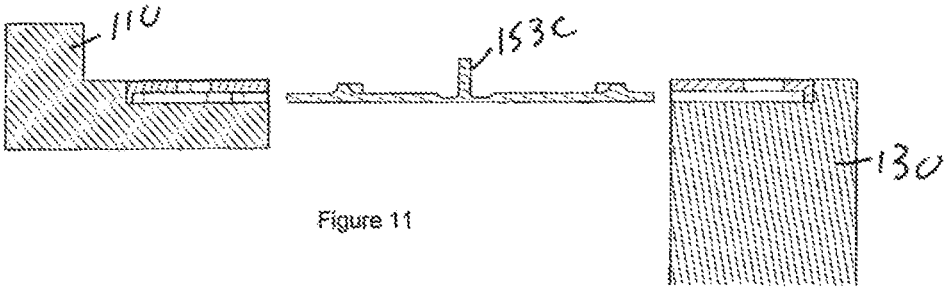
FIG. 11 is a cross-sectional view of the temporary hinge shown in FIG. 9, taken generally along the lines 11-11.

Referring to FIGS. 9 through 11, there is shown the first sequence of assembly of the temporary hinge 150 at the factory. The frame receiver 120 and panel receiver 140 are secured to the hinge jamb 110 and panel 130 by four assembly screws (not shown) through holes 121 and 141.

Figure 12:
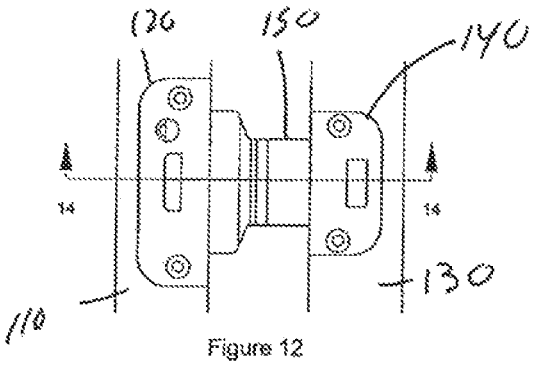
FIG. 12 is a side elevational view of the temporary hinge shown in a partially assembled position.
Figure 13:
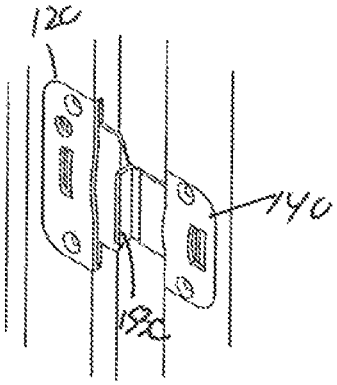
FIG. 13 is a perspective view of the temporary hinge shown in FIG. 12.
Figure 14:
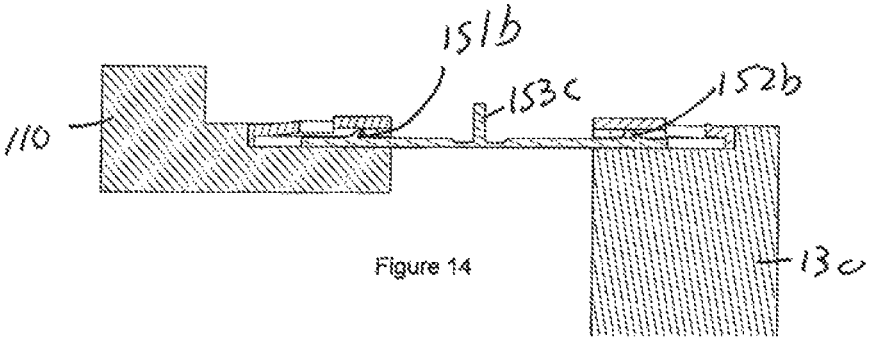
FIG. 14 is a cross-sectional view of the temporary hinge shown in FIG. 12, taken generally along the lines 14-14.

Referring to FIGS. 12 through 14, the initial assembly of the temporary hinge into the frame jamb 110 and panel 130 is shown. The frame jamb leaf 151 and panel leaf 152 are shown mid insertion. As can be seen in FIG. 14, the leaves 150, 152 cause the receivers 120, 140 to bulge slightly as the protrusions 151*b* and 152*b* are inserted.

Figure 6:
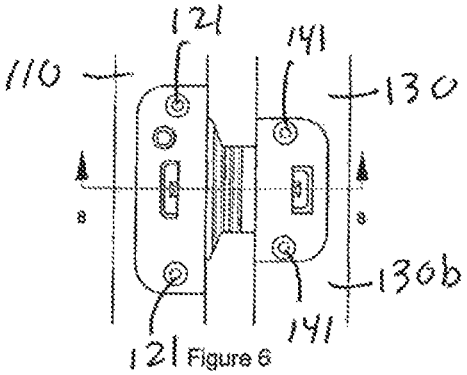
FIG. 6 is a side view of the temporary hinge, shown in FIG. 1, secured to a door panel and frame jamb (shown without four assembly screws)
Figure 7:
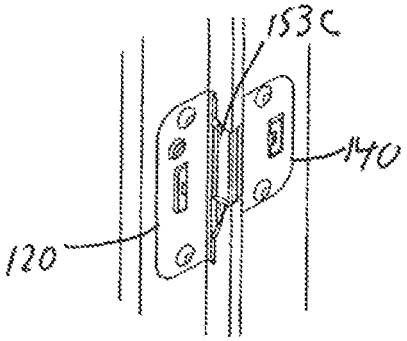
FIG. 7 is a perspective view of the assembled temporary hinge, shown in FIG. 6.
Figure 8:
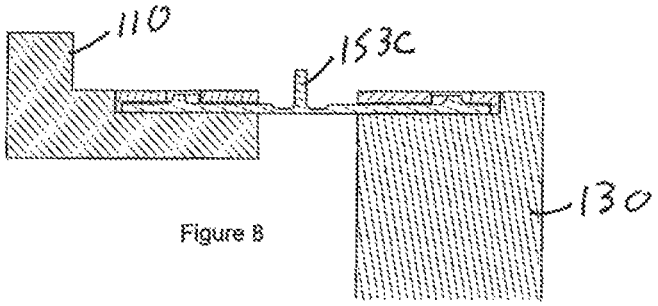
FIG. 8 is a cross-sectional view, taken generally along the lines 8-8 of FIG. 6.

Now, referring to FIGS. 6 through 8, it can be seen that the leaves 151 and 152 are fully inserted, allowing a snap-in fit of the temporary hinge 150. The protrusions 151*b* and 152*b* are captured in the snap openings 123, 143. FIG. 16 shows a perspective view of the temporary hinge 150 assembled to the panel 130 and frame jamb 110.

Figure 17:
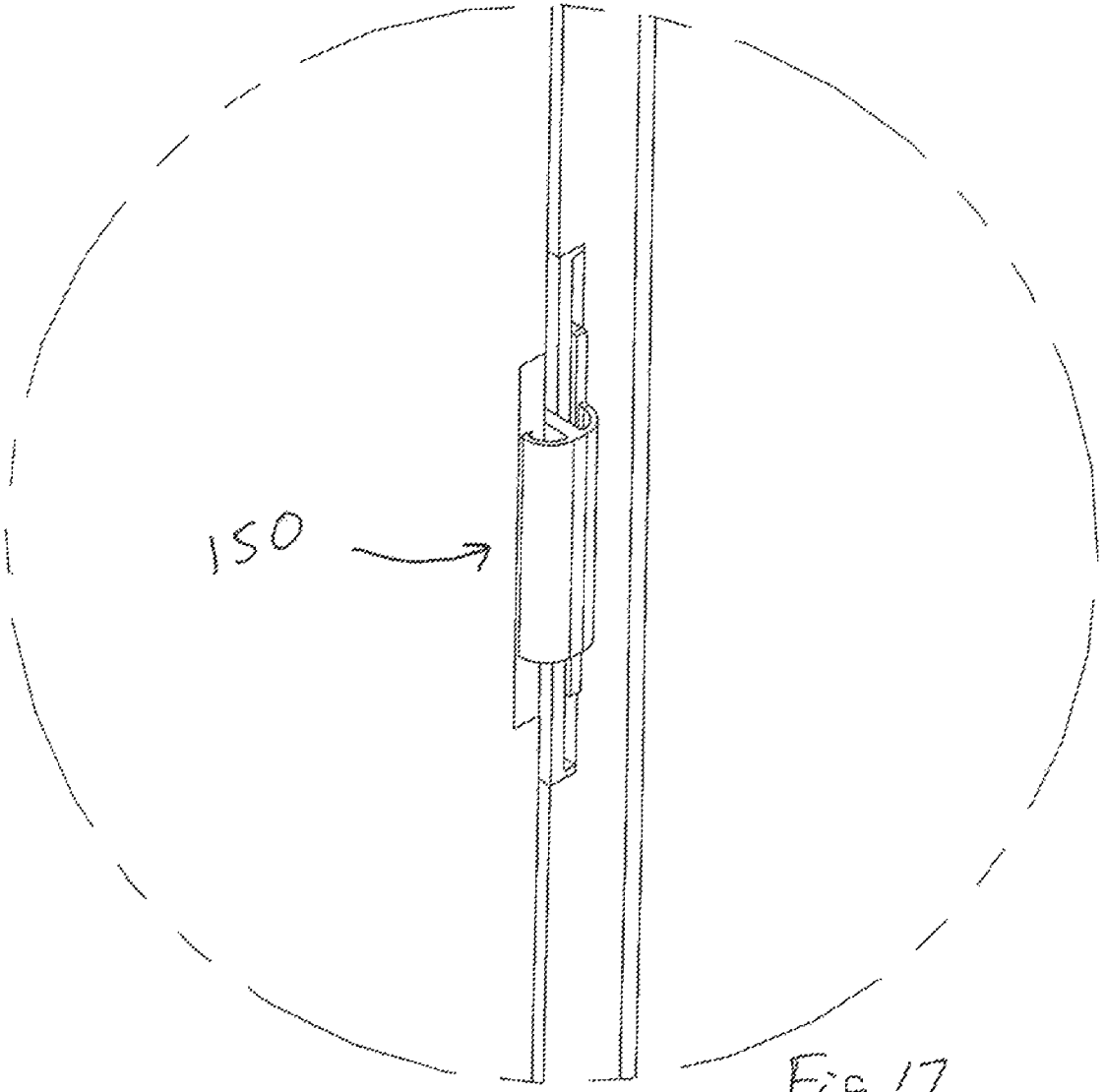
FIG. 17 is a perspective view of a factory assembled temporary hinge showing the panel and jamb in a closed position.

FIG. 17 shows a perspective view of the panel 130 and frame jamb 110 in a closed position. As can be seen, a small portion of the plastic temporary hinge 150 protrudes, as opposed to a metal barrel, as in the prior art. Also, the spacer elongate section 153*c* is shown, thereby eliminating a separate spacer, as used in the prior art.

FIG. 18 shows the installation of the door with the temporary hinge installed on the wall 300. An installation/horizontal adjustment screw 290 is inserted through the opening 124 of the receiver 120 and then through the opening 155 of the temporary hinge 150 through the opening 110C of the jamb 110 and into the wall 300. At this point, the head of the screw 290*a* is sized and configured to go through both of the openings 155 and 124. The ability for horizontal adjustment by use of the installation/adjustment screw will be described more fully hereafter.

Figure 20:
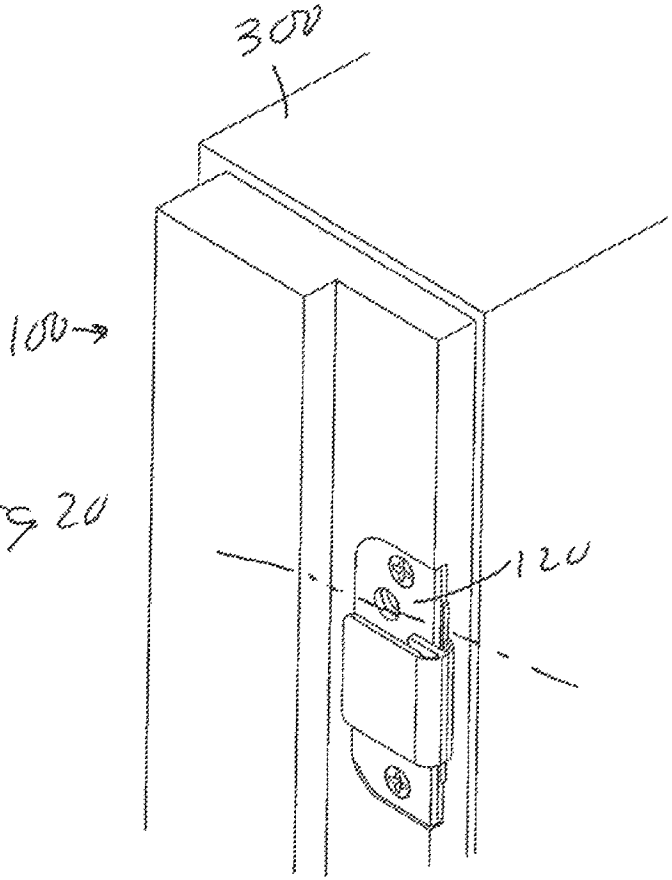
FIG. 20 is a perspective view of the temporary hinge, shown in FIG. 19, from the other side.
Figure 19:
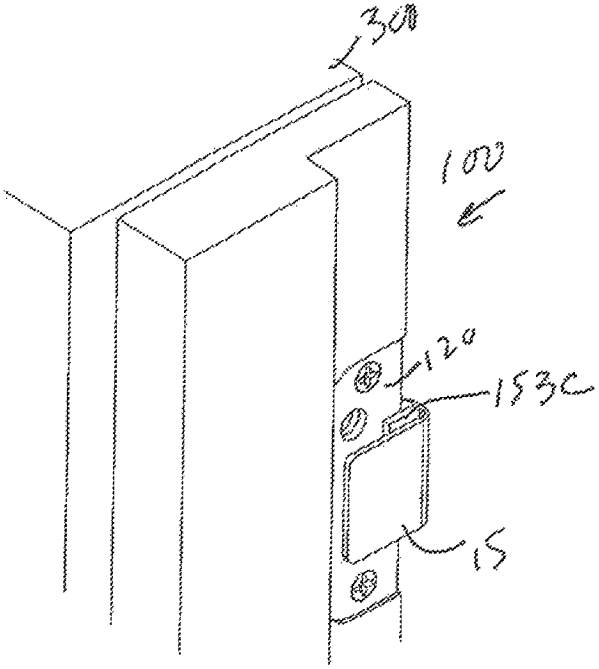
FIG. 19 is a perspective view of the temporary hinge installed with the panel removed.

FIGS. 19 through 20 show a temporary door assembly 100 fixtured to the wall 300, by suitable fasteners, well known in the art (not shown). The panel 130 has been removed from the figures for clarity so that the receiver 120 and elongated section 153*c* are shown more clearly, and how the elongate section 153*c* would act as a spacer.

Figure 24:
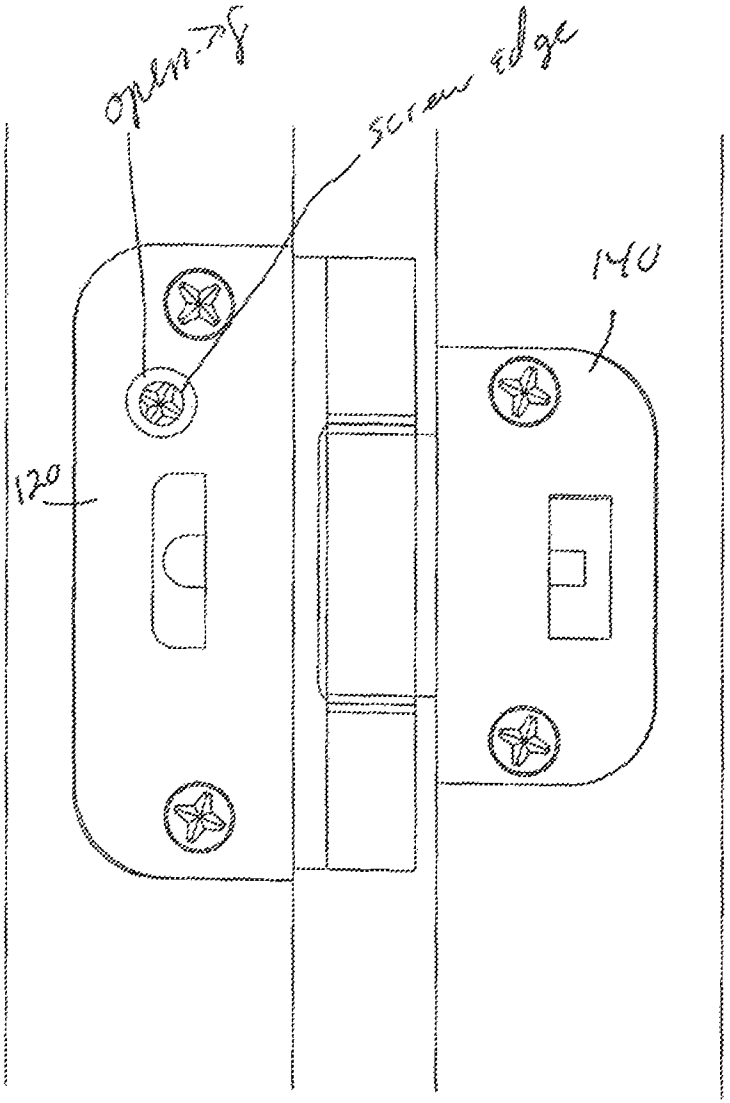
FIG. 24 is a side elevational view of the finished hinge assembled to the frame jamb and panel.
Figure 25:
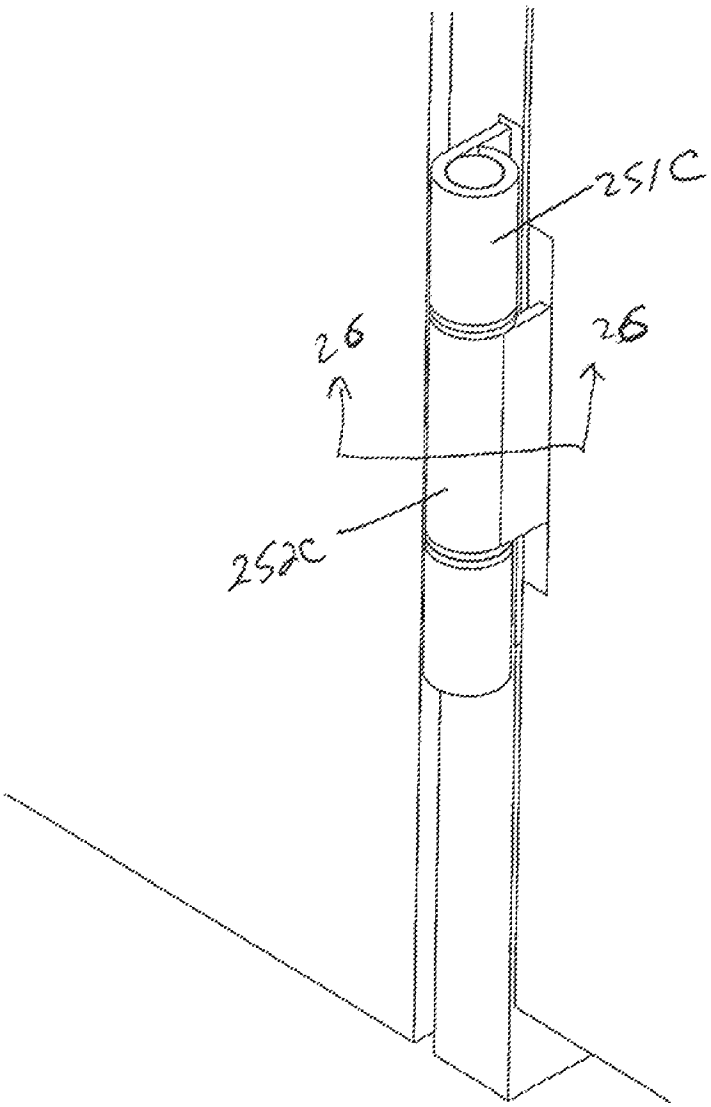
FIG. 25 is a perspective view of the finished hinge shown in FIG. 24, with the panel in a closed position.
Figure 26:
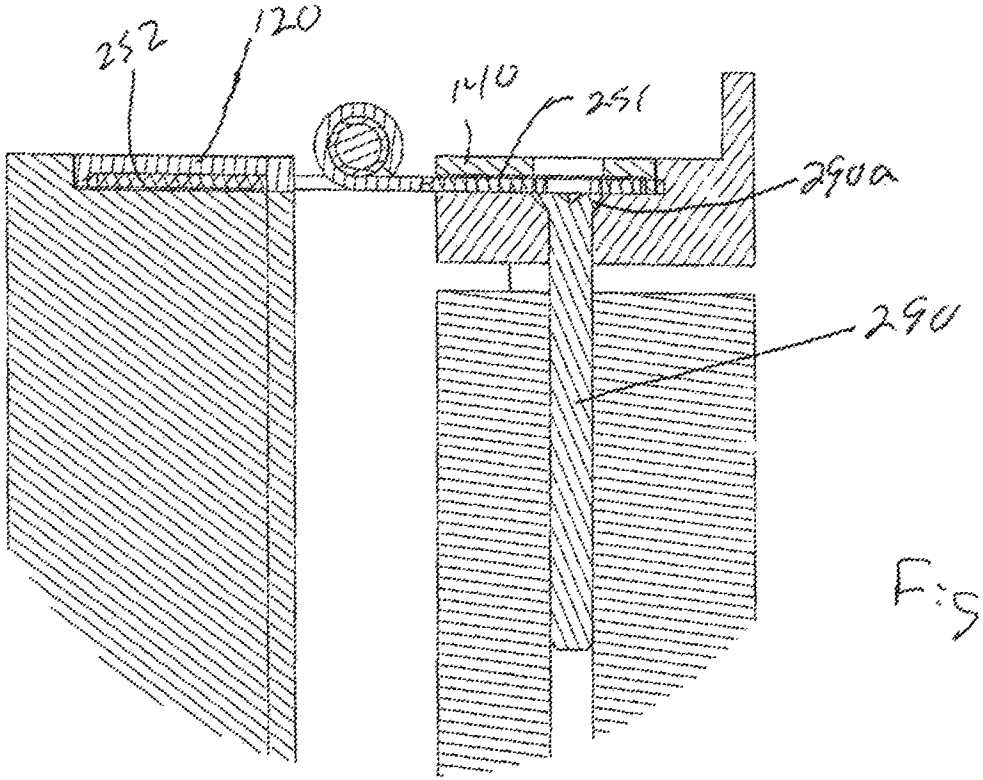
FIG. 26 is a cross-sectional view of the hinge shown in FIG. 25, taken generally along the lines 26-26.
Figure 27:
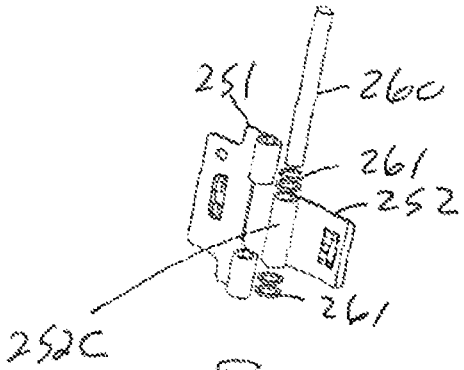
FIG. 27 is an exploded perspective showing the component parts of the replacement hinge.
Figure 2B:
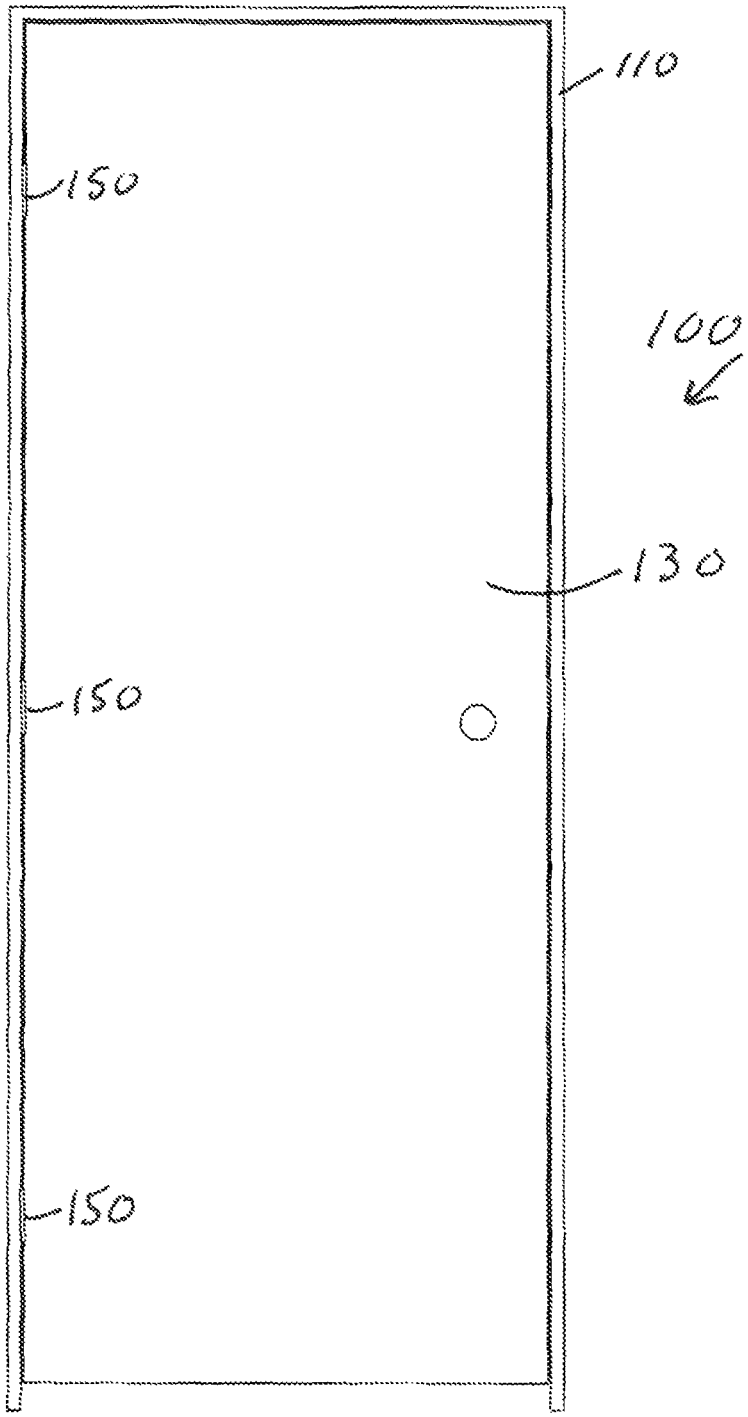

After the adjustment screw 290 has been inserted, as previously described, the frame jamb leaf 151 and panel leaf 152 are removed from the receivers 120, 140. A screwdriver or similar tool is inserted into the opening 123 or 143, depending on which leaf 151, 152 is to be removed. The receiver is bent upward by the screwdriver, allowing the protrusions 151*b*, 152*b* to become free to be pulled out. Then, the replacement hinge 250 is assembled in a manner similar to the previously described temporary hinge 150. That is, the frame jamb leaf 151 is inserted into the receiver 120 by a snap-in action. Then the panel leaf 152 is inserted into the panel receiver 140 by a snap-in action and the door assembly 200 is now installed. FIG. 24 shows a view of the replacement hinge 250 installed. FIGS. 24 through 26 show figures of the replacement hinge 250 installed. As shown in FIG. 26, it can be seen that the head 290*a* of the screw 290 has a diameter that is greater than the aperture 255. However, the aperture 255 still allows access to the head of the adjustment screw 290. Therefore, the adjustment screw 290 may be rotated, and since the head of the screw is captured by the hinge 250, rotation of the adjustment screw 290 is a very economical horizontal adjustment mechanism. If it is desired to use another replacement hinge, with say a different finish, the hinge 250 is removed with a screwdriver, as previously described with respect to the temporary hinge 150. It is recognized, that if one does not wish to use the installation/adjustment screw 290, other well known ways of installing the door assembly to a wall 300 may be utilized. For example, fasteners such as screws or nails may be inserted through the jamb into the wall 300, adhesives may be utilized to secure the jamb to the wall 300, a trim piece may be secured to the jamb and the trim piece in turn secured to the wall 300, or other suitable well known techniques may be utilized. Further it is recognized that the adjustment screw 290 may be utilized with a snap-in hinge that is not a dual snap-in hinge, but only has one leaf with a snap-in connection. Further it would be preferred that the leaf with the snap-in feature would be the frame jamb leaf.

The following is a list of the features and benefits that may result from the present invention:

Benefits for the Manufacturer:

1. Lower cost. Components that are installed at the manufacturer are less expensive than a current commodity steel hinge.
2. Easier assembly. The installation of the hinge receivers require only two screws per receiver compared to four per leaf on a commodity hinge. Also, the receivers do not require typical fixturing of the frame to the panel during installation. This is normally the high point (most constricted flow area) of the production line for door manufacturing. Snapping the panel to the frame reduces the time required for this process and also allows more flexibility when balancing the work on the production line. The temporary hinge can include the spacer between the panel and frame, thereby eliminating another component to install.
3. Fewer packaging requirements. The removal of the commodity barrel hinge reduces the size of the packaging and eliminates the packaging around the hinge barrels.
4. Less damage to adjacent products. Removal of the barrel of the hinge during transport of the door will reduce damage caused by the hinge barrel to adjacent products.

Benefits During Shipping:

1. Smaller package. The elimination of the barrel will reduce the size of the manufactured door from about 5.25" depth to about 4.75". If the shipping protector for the hinge barrel is included, the reduction is at least 0.25" greater. That increases the number of doors that can be shipped in the same space by at least 10% and up to 15%, clearly reducing the cost of shipping.
2. Barrel removal reduces damage to adjacent products. The removal of the barrel reduces the damage caused by the barrel gouging adjacent products.
3. Barrel is not damaged during shipping. The barrel itself is not able to be damaged when it is not included with the shipped door.

Benefits for the Retailer:

1. Inventory of door does not need to be maintained with respect to color of any of the hardware. Since the hinge barrel is applied by the end user, the door does not need to be inventoried for various hinge color options, thereby opening inventory room for other products.
2. New source of revenue for matched trim hardware. The hinges that are sold to match the handles will be a new source of revenue with a well understood volume potential. Current door volume is well understood and easy to predict in the short term. Increases in market share are likely due to the multiple benefits that this system will provide. Upgraded hinge designs are available with an expected higher cost and profit margin.
3. Increased customer satisfaction with matching hinges and trim sets. No removal of screws during installation or replacement process.
4. Ability to sell a new feature to differentiate from competitors using old technology. It will be obvious to consumers that this new system has benefits that they will appreciate. It shows market leadership for the retailer.
5. Fewer service issues. The design allows installer to use normal installation methods without much learning for them. They will easily understand that the temporary hinges need to be replaced. The frame adjustment mechanism allows very easy adjustment of the frame to repair out of square installations. This feature can be utilized at any time by installing a screw in the installation position of the hinge. The removal of the hinge screws is a consistent problem that is no longer present with the new design.
6. Reduction of damage to and by hinge barrel. Similar those issues described in shipping section.

Benefits to the Installer/Contractor:

1. Panel is easily removed and set aside during construction process. Temporary hinge is unsnapped from the frame so that power cords and other items do not damage the panels during the construction process.
2. Allows panels to be easily removed for painting and staining. No screws are removed. Screws are easily stripped upon reapplication as the screw threads lose about 30% of their strength when carefully applied. They will lose more strength if too much torque is applied. Stripped screws are a nuisance for any commodity door hinge removal and reinstallation.
3. Less damage during transport to the jobsite. The barrel of the hinge sticking out is a problem during all of the delivery phases.
4. Opportunity to differentiate from competitors that so not have this system. The benefits to the homeowner can be sold as an upgrade over competitors that do not have the features of this new design.

Benefits to the Homeowner:

1. An opportunity to easily have all of the hardware on the door match. Upgraded designs can include a variety of styles to match the homes character. Homeowner will no longer have to ignore the difference between the finish of the hinges and the handle.
2. Allows easy changing of the hinge appearance in the future for a remodeling update. Installation of hinges is easier than that for the handle.
3. Allows easy removal of the panel to prevent damage during move-in or other times that damage might occur.
4. No metal to metal contact insures silent hinge operation forever.
5. Easily able to adjust an out of square installation with adjustment mechanism.

The above specification, examples and data provide a complete description of the manufacture and use of the composition of the invention.

The invention claimed is:

1. A method of installing a door assembly having a panel and a jamb the method comprising:

(a) installing the door assembly to a wall, the panel and the jamb being operatively connected with a temporary hinge prior to installation and during installation, the temporary hinge being made of plastic, the temporary hinge including a jamb leaf operatively connected to the jamb and a panel leaf operatively connected to the panel, the jamb leaf and the panel leaf interconnected by a flexible portion having a groove formed therein, the flexible portion configured and arranged to bend at the groove thereby allowing the panel to move relative to the jamb, the temporary hinge including an elongate section extending upward from proximate the flexible portion and the groove and, when the panel and the jamb are in a closed position, the elongate section is configured and arranged to be positioned between and extend parallel to opposing surfaces of the panel and the jamb thereby acting as a spacer therebetween;

(b) removing the temporary hinge by releasing a snap fit between the jamb leaf and a jamb receiver and by releasing a snap fit between the panel leaf and a panel receiver;

(c) replacing the temporary hinge with a replacement hinge by snapping a replacement hinge panel leaf into the panel receiver and snapping a replacement hinge jamb leaf into the jamb receiver.

2. The method of claim 1, further comprising the temporary hinge having an opening in the jamb receiver and an opening in the jamb leaf through which an installation screw is inserted, thereby securing the door assembly to the wall.

3. The method of claim 1, further comprising securing the door assembly to the wall with a fastener.

4. The method of claim 1, wherein the replacement hinge has a barrel.

5. The method of claim 1, further comprising:

(a) the jamb receiver having an installation/adjustment opening having a first size; and (b) the replacement hinge jamb leaf having an adjustment/installation opening having a second size, wherein an installation/adjustment screw has a head having a third size, the third size being larger than the second size, whereby the jamb receiver allows the insertion of the installation/adjustment screw and the second size is smaller than the third size but still allows access to the screw head, whereby the screw head is captured between the replacement hinge jamb leaf and the jamb and rotation of the installation/adjustment screw provides for horizontal adjustment of the jamb relative to the wall.

6. The method of claim 1, wherein the flexible portion, the panel leaf, and the jamb leaf are integral.

7. The method of claim 1, the replacement hinge further comprising a barrel having a metal frame jamb leaf barrel extension rotatably connected to a metal panel leaf barrel extension by a plastic pin and having plastic bushings positioned between the frame leaf barrel extension and the panel leaf barrel extension.

8. The method of claim 1, wherein the groove includes a first groove and a second groove, the elongate section extending from the flexible portion between the first and second grooves.

9. A method of installing a door assembly having a panel and a jamb, the method comprising:

operatively connecting the panel and the jamb with a temporary hinge, the temporary hinge being made of plastic, the temporary hinge including a jamb leaf operatively connected to the jamb and a panel leaf operatively connected to the panel, the jamb leaf and the panel leaf interconnected by a flexible portion configured and arranged to allow the panel to move relative to the jamb, the temporary hinge including an elongate section extending upward from proximate the flexible portion and, when the panel and the jamb are in a closed position, the elongate section is configured and arranged to be positioned between and extend parallel to opposing surfaces of the panel and the jamb thereby acting as a spacer therebetween;

shipping the door assembly to a location with a wall, the panel and the jamb being operatively connected with the temporary hinge during shipping;

installing the door assembly to the wall including interconnecting the jamb and the wall with an installation/adjustment fastener;

removing the temporary hinge by releasing a snap fit between a jamb leaf and a jamb receiver and by releasing a snap fit between a panel leaf and a panel receiver;

replacing the temporary hinge with a replacement hinge by snapping a replacement hinge panel leaf into the panel receiver and snapping a replacement hinge jamb leaf in the jamb receiver; and adjusting a distance between the jamb and the wall by rotating the installation/adjustment fastener when either the temporary hinge or the replacement hinge interconnects the panel and the jamb.

10. The method of claim 9, further comprising the temporary hinge having an opening in the jamb receiver and an opening in the jamb leaf through which the installation/adjustment fastener is inserted, thereby securing the door assembly to the wall.

11. The method of claim 9, further comprising:

the jamb receiver having an installation/adjustment opening having a first size; and the replacement hinge jamb leaf having an adjustment/installation opening having a second size, wherein the installation/adjustment fastener has a head having a third size, the third size being larger than the second size, whereby the jamb receiver allows the insertion of the installation/adjustment fastener and the second size is smaller than the third size but still allows access to the head, whereby the head is captured between the replacement hinge jamb leaf and the jamb and rotation of the installation/adjustment fastener provides for horizontal adjustment of the jamb relative to the wall.

12. The method of claim 9, further comprising the temporary hinge having a flexible portion operatively connecting the panel leaf to the jamb leaf.

13. The method of claim 9, the replacement hinge further comprising a barrel having a metal frame jamb leaf barrel extension rotatably connected to a metal panel leaf barrel extension by a plastic pin and having plastic bushings positioned between the frame leaf barrel extension and the panel leaf barrel extension.

14. The method of claim 9, wherein the temporary hinge is replaced with the replacement hinge after the door assembly has been installed to the wall.

15. The method of claim 9, wherein the flexible portion has a first groove and a second groove formed therein and the flexible portion is configured and arranged to bend at the first and second grooves, the elongate section extending from the flexible portion between the first and second grooves.

16. A method of installing a door assembly having a panel and a jamb, the method comprising:

operatively connecting the panel and the jamb with a temporary hinge, the temporary hinge being made of plastic, the temporary hinge including a jamb leaf operatively connected to the jamb and a panel leaf operatively connected to the panel, the jamb leaf and the panel leaf interconnected by a flexible portion configured and arranged to allow the panel to move relative to the jamb, the temporary hinge including an elongate section extending upward from proximate the flexible portion and, when the panel and the jamb are in a closed position, the elongate section is configured and arranged to be positioned between and extend parallel to opposing surfaces of the panel and the jamb thereby acting as a spacer therebetween;

shipping the door assembly to a location with a wall, the panel and the jamb being operatively connected with the temporary hinge during shipping; and installing the door assembly to the wall including interconnecting the jamb and the wall with an installation/adjustment fastener; and adjusting a distance between the jamb and the wall by rotating the installation/adjustment fastener when either the temporary hinge or a replacement hinge interconnects the panel and the jamb.

17. The method of claim 16, further comprising:

removing the temporary hinge by releasing a snap fit between a jamb leaf and a jamb receiver and by releasing a snap fit between a panel leaf and a panel receiver;

and replacing the temporary hinge with the replacement hinge by snapping a replacement hinge panel leaf into the panel receiver and snapping a replacement hinge jamb leaf in the jamb receiver.

18. The method of claim 17, wherein the temporary hinge is replaced with the replacement hinge after the door assembly has been installed to the wall.

19. The method of claim 16, further comprising the temporary hinge having an opening in a jamb receiver and an opening in a jamb leaf through which the installation/adjustment fastener is inserted thereby securing the door assembly to the wall.

20. The method of claim 16, wherein the temporary hinge includes a jamb leaf and a panel leaf interconnected by a flexible portion having a groove formed therein, the flexible portion configured and arranged to bend at the groove.

21. The method of claim 16, further comprising when the replacement hinge interconnects the panel and the jamb:

the jamb including a jamb receiver having an installation/adjustment opening having a first size; and the replacement hinge including a replacement hinge jamb leaf having an adjustment/installation opening having a second size, wherein the installation/adjustment fastener has a head having a third size, the third size being larger than the second size, whereby the jamb receiver allows the insertion of the installation/adjustment fastener and the second size is smaller than the third size but still allows access to the head, whereby the head is captured between the replacement hinge jamb leaf and the jamb and rotation of the installation/adjustment fastener provides for horizontal adjustment of the jamb relative to the wall.

22. The method of claim 16, wherein the flexible portion has a first groove and a second groove formed therein and the flexible portion is configured and arranged to bend at the first and second grooves, the elongate section extending from the flexible portion between the first and second grooves.

23. A method of installing a door assembly having a panel and a jamb, the method comprising:

installing the door assembly to a wall including interconnecting the jamb and the wall with an installation/adjustment fastener, the panel and the jamb being operatively connected with a temporary hinge made of plastic during installation, the temporary hinge including a jamb leaf operatively connected to the jamb and a panel leaf operatively connected to the panel, the jamb leaf and the panel leaf interconnected by a flexible portion configured and arranged to allow the panel to move relative to the jamb, the temporary hinge including an elongate section extending upward from proximate the flexible portion and, when the panel and the jamb are in a closed position, the elongate section is configured and arranged to be positioned between and extend parallel to opposing surfaces of the panel and the jamb thereby acting as a spacer therebetween; and adjusting a distance between the jamb and the wall by rotating the installation/adjustment fastener when the temporary hinge hinge interconnects the panel and the jamb.

24. The method of claim 23, further comprising replacing the temporary hinge with a replacement hinge;

the jamb including a jamb receiver having an installation/adjustment opening having a first size; and the replacement hinge including a replacement hinge jamb leaf having an adjustment/installation opening having a second size, wherein the installation/adjustment fastener has a head having a third size, the third size being larger than the second size, whereby the jamb receiver allows the insertion of the installation/adjustment fastener and the second size is smaller than the third size but still allows access to the head, whereby the head is captured between the replacement hinge jamb leaf and the jamb and rotation of the installation/adjustment fastener provides for horizontal adjustment of the jamb relative to the wall.

25. The method of claim 23, wherein the flexible portion has a first groove and a second groove formed therein and the flexible portion is configured and arranged to bend at the first and second grooves, the elongate section extending from the flexible portion between the first and second grooves.

* * * * *